United States Patent [19]

Seiz et al.

[11] Patent Number: 5,060,683

[45] Date of Patent: Oct. 29, 1991

[54] TENSION CONTROL FOR STRIP PICKLING

[75] Inventors: Carl G. Seiz, Hatfield; Clyde G. Robinson, Lansdale, both of Pa.

[73] Assignee: Continental Installers Corporation, Perkasie, Pa.

[21] Appl. No.: 645,261

[22] Filed: Jan. 24, 1991

Related U.S. Application Data

[62] Division of Ser. No. 506,451, Apr. 9, 1990, Pat. No. 4,996,998, which is a division of Ser. No. 233,374, Aug. 18, 1988, Pat. No. 4,920,995.

[51] Int. Cl.[5] ..... B08B 3/08; B65H 23/192

[52] U.S. Cl. ..... 134/64 R; 134/113; 226/44; 226/108

[58] Field of Search ..... 134/64 R, 122 R, 113; 226/42, 43, 44, 45, 108, 111

[56] References Cited

U.S. PATENT DOCUMENTS

| | | | |
|---|---|---|---|
| 131,681 | 9/1872 | Hill | 134/64 R X |
| 1,265,328 | 5/1918 | Henderson | 226/42 |
| 2,143,147 | 1/1939 | Ferris | 226/42 |
| 2,348,232 | 5/1944 | Trautman et al. | 134/122 R X |
| 2,544,467 | 3/1951 | Michel | 226/44 X |
| 3,811,304 | 5/1974 | Gorker | 226/42 X |
| 3,911,785 | 10/1975 | Hood . | |
| 4,807,653 | 2/1989 | Cipriano et al. | 134/64 R |

*Primary Examiner*—Philip R. Coe

*Attorney, Agent, or Firm*—Howson and Howson

[57] ABSTRACT

A process and apparatus for removing oxides, millscale and other impurities from continuous metal strip longitudinally fed at regulated speeds from a coil at one end through a series of horizontally aligned treatment stages, including three shallow pickling tanks, to a recoiler at the other end. The pickling tanks are constructed of granite slabs formed into a V-shaped cross section near the ingress and a flat ramp near the egress. Variable speed pinch rolls at the ends of each tank regulate the immersion of the strip in the tanks.

9 Claims, 15 Drawing Sheets

CLEAN AIR
206
248
244
252
250
255
WATER SUPPLY
258
256
FROM RINSER VALVE 202
30
32
33
S
35
37
39
34
36
38
61
60
61
63

54
55
54a
53
51b
36
38
S
57
58
58
50a
53
52
50b
56
42a
51a
44
46
43
34
48
39
47
40
42b
45
37
41
42
48

FIG. 9
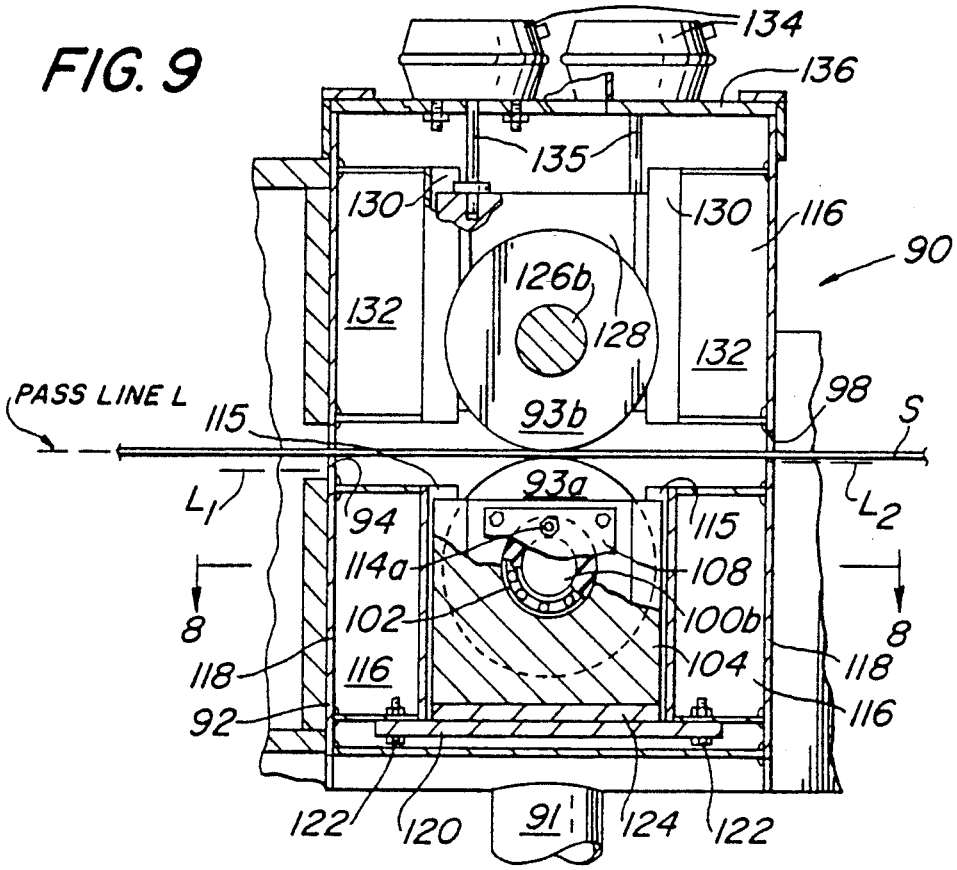
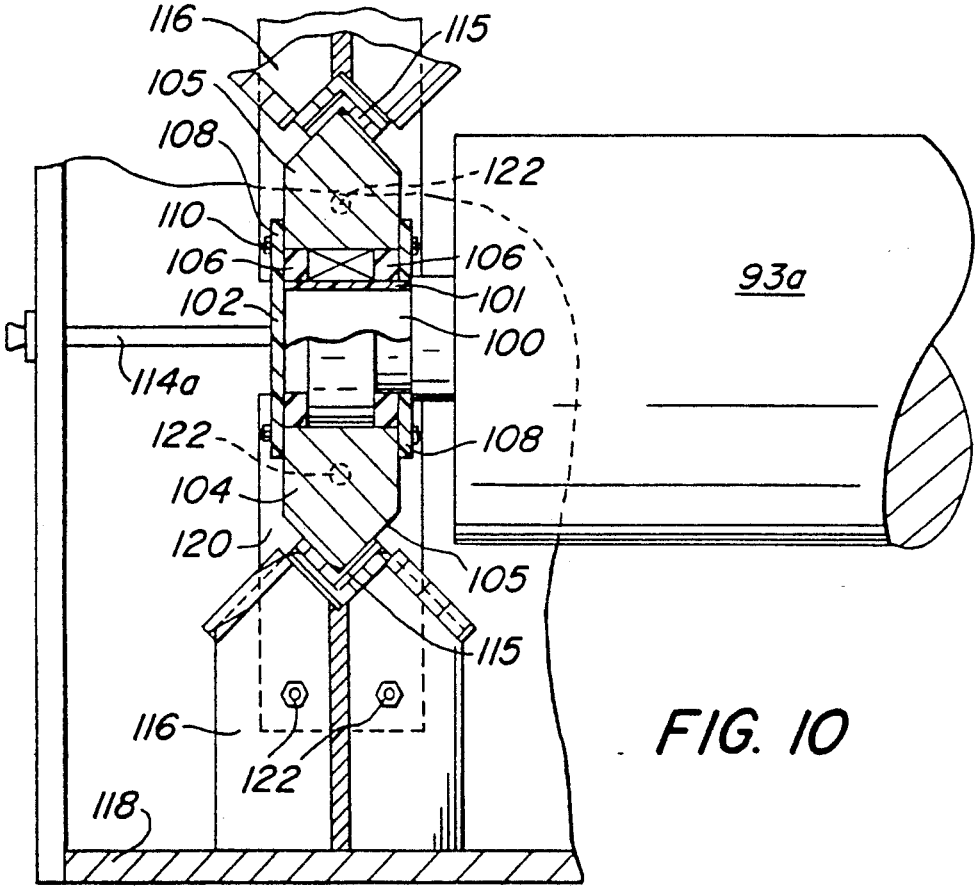
FIG. 10

TENSION CONTROL FOR STRIP PICKLING

CROSS REFERENCE TO RELATED APPLICATION

This is a division of copending application Ser. No. 07/506,451 filed Apr. 9, 1990, and now U.S. Pat. No. 4,996,998 which is a division of application Ser. No. 07/233,374 filed Aug. 18, 1988, and now U.S. Pat. No. 4,920,995.

BACKGROUND OF THE INVENTION

The present invention relates to cleaning metal and the like by liquid contact; and more particularly, to an improved process and apparatus for removing oxides, millscale and other impurities from continuous strip metal traveling through plural stages of pickling and rinsing with recirculated solutions.

Objectionable oxides, millscale and the like formed on or adhered to the surface of steel after milling or metal working are usually removed by immersion in an acidic solution or so-called pickling. In a continuous pickling process the steel in strip form travels longitudinally through a series of pickling and rinsing solutions at a regulated speed. The efficiency with which this is accomplished is dependent on several factors including the temperatures of the strip and the solutions, acidity of the solutions, and duration the strip is immersed. Prior art systems have been found inadequate for controlling all of these factors with the precision needed to produce steel strip with high surface quality while realizing effective chemical waste treatment, conservation of acid and water, and uninterrupted processing. For example, U.S. Pat. No. 2,166,583 to Critten discloses a process in which the strip is longitudinally transported through a series of pickling and rinse tanks. Hold-down rollers in the tanks keep the strip immersed while pinch rolls at each end of the series keep the strip taut as it passes through each tank. Spent acid in any tank may be drained by gravity to a dump tank within the series and replaced by fresh acid without interrupting operation of the other tanks. U.S. Pat. No. 2,697,050 to Barnes discloses a similar process except the pickling solution flows by gravity through the tanks in the same direction as the strip travels and the acid in the last tank is recirculated to the first tank. Fresh acid is added to the first tank when needed to raise the overall acidity. In some processes the spent acid is also purified and regenerated before it is recirculated. U.S. Pat. No. 3,445,284 to Robinson Jr., et al, for instance, removes any accumulated solids and distills the remaining acid to a higher concentration.

There is still a growing demand for pickling processes which are even more efficient and less detrimental to the environment. Some of the prior art systems require extensive waste chemical treatment to ensure there is no harmful discharge into the air, streams or ground. Still others consume large amounts of acid, employ costly regenerating systems for acid conservation, or require large quantities of water. Also, many critical and expensive components within these systems are often short lived due to their continuous exposure to the pickling solutions, and therefore require frequent replacement. More precise control of acid concentration, strip and pickling solution temperatures and immersion time are also required for improved product quality.

SUMMARY OF THE INVENTION

Accordingly, it is an object of the present invention to provide an improved process and apparatus for pickling continuous strip metal which is capable of precisely controlling the acid concentration, temperature and immersion time within a series of pickling solutions at desired levels and durations.

Another object of the invention is to provide a pickling process and apparatus in which the speed of continuous strip metal through a pickling process is precisely controlled at selected points along the travel for ensuring full immersion of the strip in the several pickling or rinse solutions.

Still another object of the invention is to provide an acid recirculating system for a series of pickling solutions in which acid consumption is minimized and the concentration in each solution is substantially and independently regulated, in which the pickling solution is recirculated within each pickling tank, and in which pickling solution in one tank may flow by gravity to a selected preceding tank.

A further object of the invention is to provide a versatile electrohydraulic drive system for transporting a continuous strip through a pickling process in which the speed is regulated according to the vertical displacement of the strip in each pickling tank.

Still further objects are to provide an improved bearing for pinch rollers of a pickling system which enables use of conventional, off-the-shelf roller bearings substantially isolated from exposure to acid, a shallow pickling tank which enables thin-gage metal strip to be pushed lengthwise through the pickling solution during initial loading, an acid conservation system which recovers and recirculates acid present in vapors given off by the pickling solutions, and a camber system which compensates for linear irregularities in the strip.

Briefly, these objects are accomplished by a pickling process and apparatus in which continuous metal strip is longitudinally fed at regulated speeds from a coil at one end through a series of horizontally aligned treatment stages to a recoiler at the other end. The strip advances through a preheater and a series of shallow pickling tanks, each containing a heated solution of controlled hydrogen-ion activity. Within the preheater a heated pickling solution flushes the top and bottom surfaces of the strip to raise its temperature. The preheater is divided into four troughs which collect the solution for recirculation through a series of head tanks connected to each other to allow the solution to cascade in counterflow to the strip travel as more solution is added to the last head tank. As the strip enters each pickling tank a jet of pickling solution impinges the upper surface and flows downstream where it is drawn off, filtered of particulates, and recirculated through a head tank and heater. The head tanks of the pickling tanks are connected to each other and to the preheater head tanks to enable the solution to cascade in counterflow to the strip travel as the solution is added to a downstream tank. A rinser following the pickling tanks flushes the top and bottom of the strip with heated water. The rinser is divided like the preheater into troughs which collect the water for recirculation through a series of head tanks connected to each other to allow the water to cascade in counterflow to strip travel as more water is added to the last head tank. The strip finally passes through an oiler and under a dead weight roller which compensates for linear irregularities in the strip metal before it is rewound.

The speed at which the strip passes through the various treatment stages is regulated by a unique arrangement of electrically controlled variable displacement hydraulic pumps and motors. The stroke of each pump is electrically varied according to a desired strip speed, and the hydraulic output drives the motor to produce a rotary output to strip drive rollers. The stroke of the motor is electrically varied by strip sag sensors which regulate the relative speed of adjacent rollers along the process.

Other objects, novel features, and advantages of the invention will become more apparent from the following detailed description when considered in conjunction with the accompanying drawings wherein:

BRIEF DESCRIPTION OF THE DRAWINGS

FIG. 9 is a sectional view of the pinch rolls taken along the line 9—9 of FIG. 8;

FIG. 10 is a sectional view of a pinch roll taken along the line 10—10 of FIG. 8;

DESCRIPTION OF THE PREFERRED EMBODIMENT

Figure 1A:
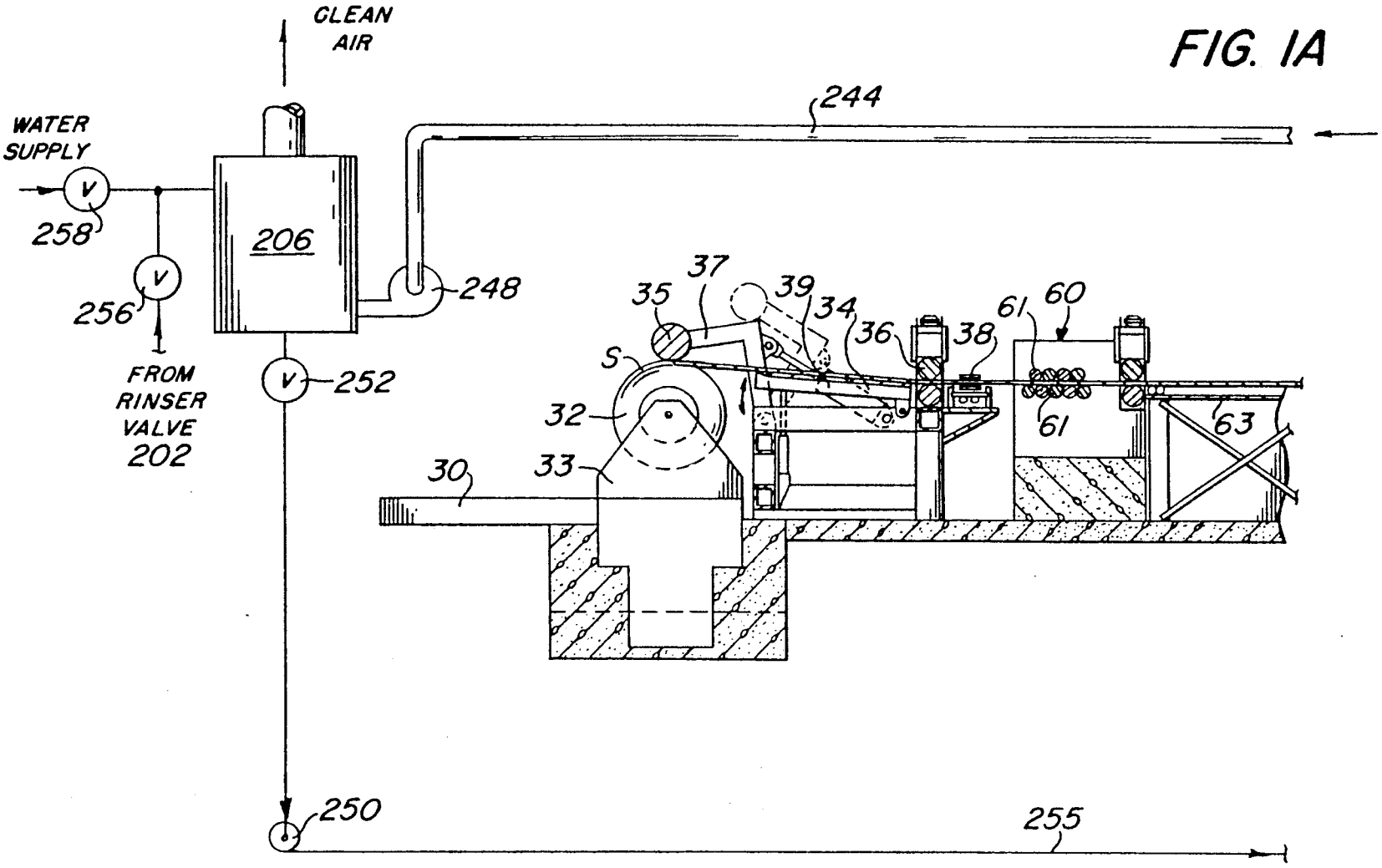
FIGS. 1A-1F taken together represent a schematic side elevation of a continuous steel strip pickling apparatus according to the invention.

Referring now to the drawings wherein like characters designate like or corresponding parts throughout the several views, there is shown in FIGS. 1A through 1F a pickling line for removing oxides, millscale, and other contaminating residues and impurities present on steel strip after milling, handling or storage. The pickling process starts in FIG. 1A from a loading ramp 30 with a coil of metal strip S unwinding from a motor-driven uncoiler 32 journaled in a stand 33 which is laterally positionable by hydraulic actuators, not shown, for initial strip alignment. Metal strip up to 96" width and ⅜" thick is capable of being processed in one apparatus constructed according to the invention. A peeler 34 separates the exposed end of the strip for feeding into pinch rolls 36 and edge guides 38 mounted on peeler 34. For shipping and storage, the coils are usually bound with steel bands to prevent the strip S from unwinding. However, after the coils are placed on uncoiler 32 and the bands cut, some strips tend to spring open and unwind by themselves. To prevent this, a hold-down roller 35, pivally mounted across peeler 34 on opposite angle arms 37, is urged by hydraulic actuators 39 on opposite sides against the exposed end of coiled strip S until it has been fed through pinch rolls 36 and guides 38.

Figure 2:
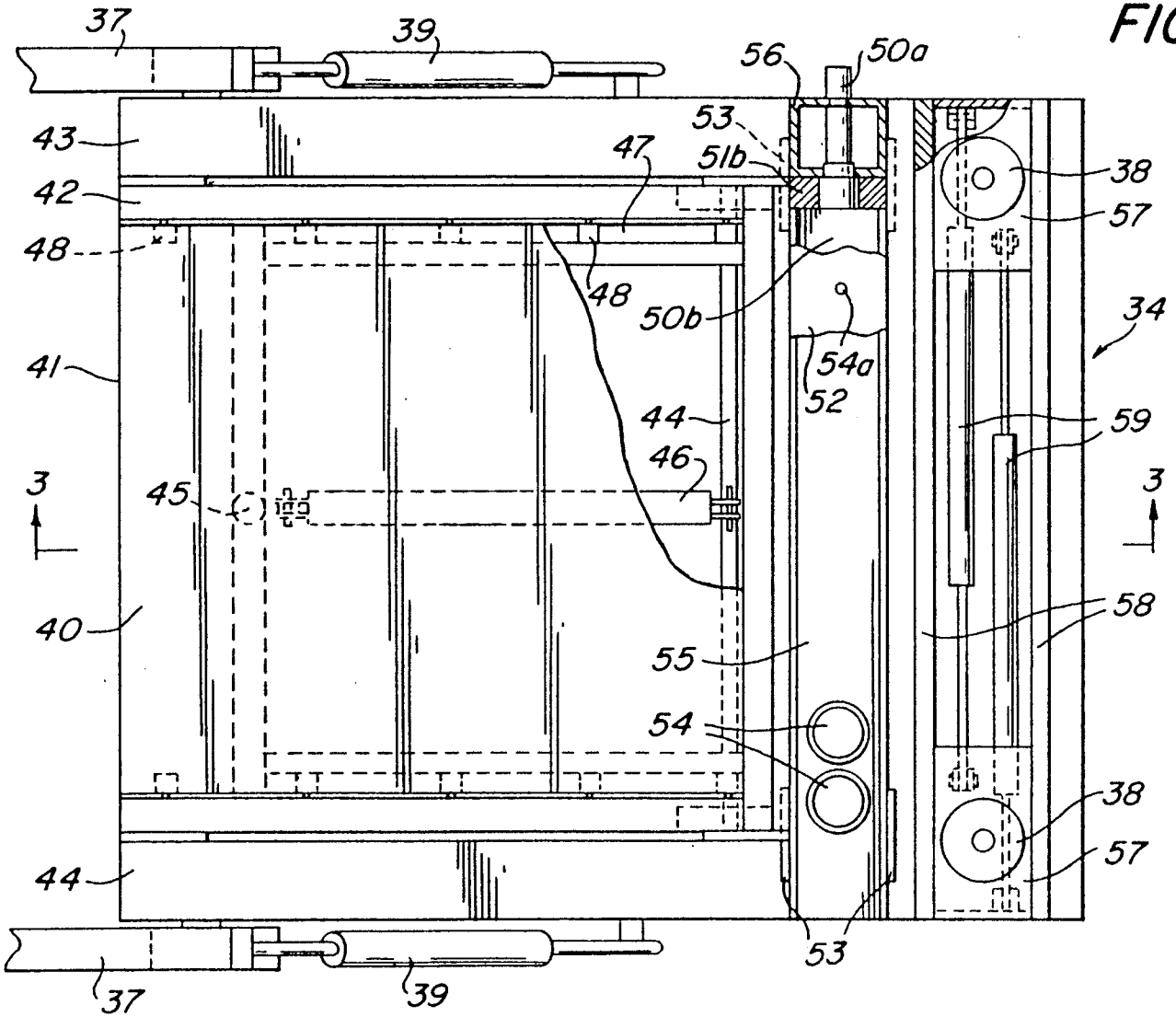
FIG. 2 is a more detailed plan view of a peeler assembly in the apparatus of FIG. 1A for unwinding the exposed end of coiled strip.
Figure 3:
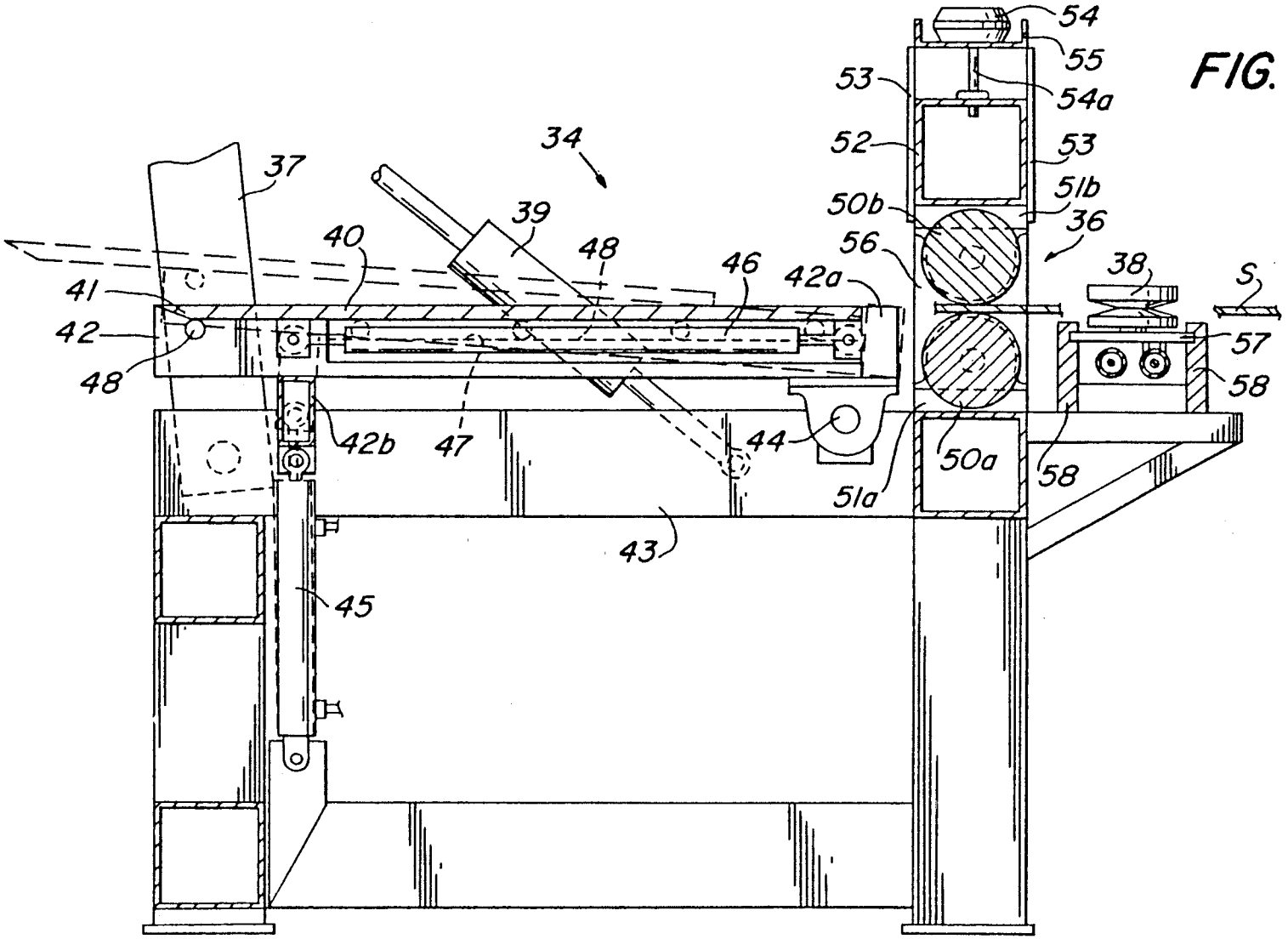
FIG. 3 is a vertical section of the peeler assembly taken along the line 3—3 of FIG. 2.

Referring to FIGS. 2 and 3, peeler 34 includes a base 43 pivotally supporting a frame 42 at an aftward crossmember **42*a* on a transverse shaft 44. Tracks 47 and rollers 48 on either side of frame 42 support a blade 40 having its forward edge 41 beveled for prying under the uncoiled end of strip S on the uncoiler 32. A hydraulic actuator 45 connected between a forward crossmember 42*b* of frame 42 and base 43 provides angular adjustment of blade 40 about shaft 44. A hydraulic actuator 46 connected between member 42*a* and blade 40 provides forward translation of edge 41** into the coiled strip S.

Pinch rolls 36 consist of a lower motor-driven roller **50*a* supported at either end on base 43 by journals 51*a*, and an upper idler roller 50*b* supported at either end on a horizontal beam 52 by journals 51*b*. Beam 52 is vertically moveable within fixed guides 53 by pairs of pneumatic actuators 54 mounted on each end of a channel 55 extending between vertical columns 56 of base 43. The pinch force between rollers 50*a* and 50*b* transmitted by pushrods 54*a* is controlled by the air pressure applied in actuators 54**.

The two edge guides 38 are moveable from either side of peeler 36 to center strip S through the process. Each guide 38 is rotatably mounted on a shuttle 57 in opposed tracks 58 across the strip. Shuttles 57 are laterally positioned according to hydraulic actuators 59 connected between respective ones of shuttles 57 and base 43.

Strip S then passes through a conventional flattener 60 in which motor-driven rollers 61 remove any coil memory from the strip, and over a span 63 to a conventional shear 64 (FIG. 1B) which trims off any irregularities at the beginning and end of strip S. Scrap ends drop into a bin, not shown, and the remaining strip S at a passline L elevation continues over an idler roller 65.

Strip S then passes over a span 67 to motor-driven pinch rolls 66 at the entrance to an enclosed preheater 70 where a heated weak acidic solution, such as 3% by volume HCl near the boiling point, flushes both sides of the approaching strip S through nozzles in four crosswise headers 72. Pinch rolls 66 are constructed like pinch rolls 36.

Figure 4:
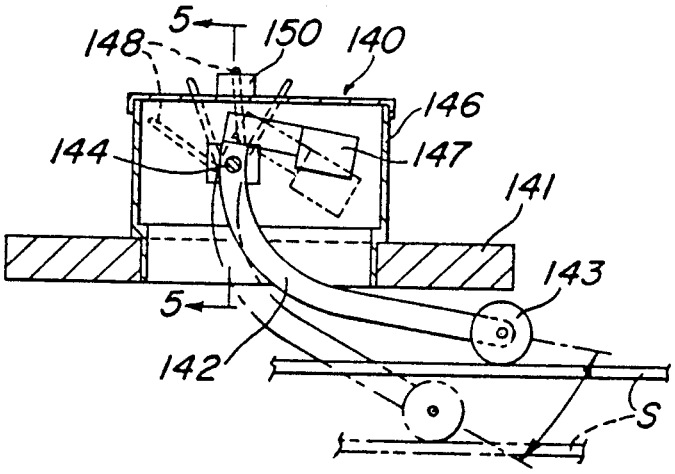
FIG. 4 is an elevation view of a sag sensor for detecting the tension in the strip.
Figure 5:
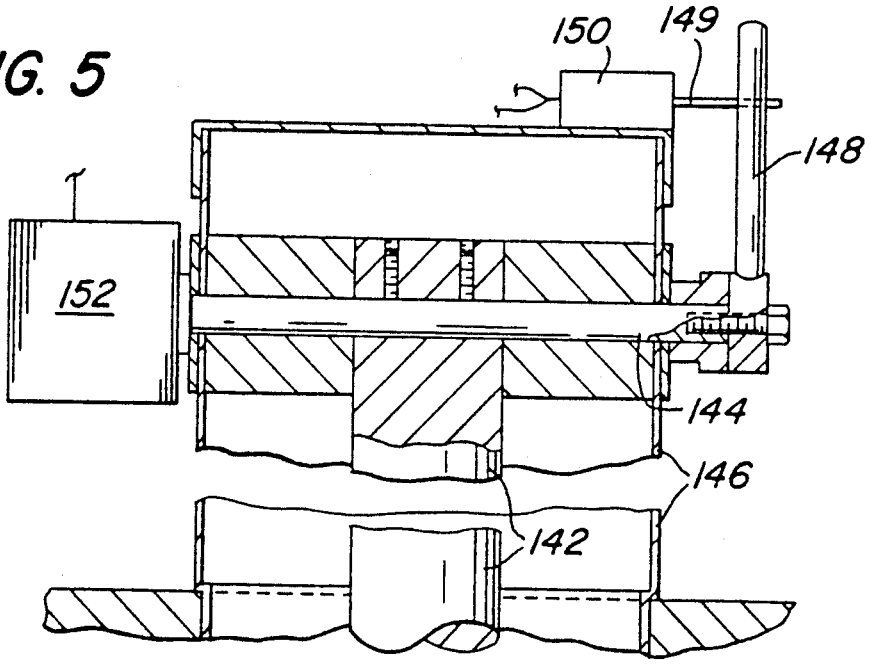
FIG. 5 is a sectional view of the sag sensor taken along the line 5—5 of FIG. 4.

The length of strip A between the idler roller 65 and rolls 66 is maintained slightly in excess of the distance between idler roller 65 and rolls 66 to form a loop or sag which allows the speed of rolls 66 to be adjusted independently of roller 65 as described hereinafter. In the preferred embodiment, a sag of 10" has been determined sufficient for this purpose. The sag is measured by a sensor or so-called dancer **140*a* which is supported from above and midway across strip S by a cross beam 141 positioned approximately at mid span. Referring to FIGS. 4 and 5, dancer 140*a* includes a U-shaped arm 142 pivotal between the ends about a shaft 144 within a casing 146. A weight 147 at one end of arm 142 urges a wheel 143, preferrably of polypropylene, at the other end downward onto strip S. A transducer 152 mounted at one end of shaft 144 produces an electrical signal indicative of the vertical position of wheel 143. As the tension in strip S changes, the sag causes shaft 144 to rotate and produce a corresponding change in the electrical signal. Two fingers 148 radially extending from shaft 144 straddle an armature 149 of a limit switch 150. The positions of fingers 148 are set to actuate switch 150 when the strip sag exceeds a selected operating range. The manner in which transducer 152 and switch 150** control strip speed are fully described herein below.

Figure 1B:
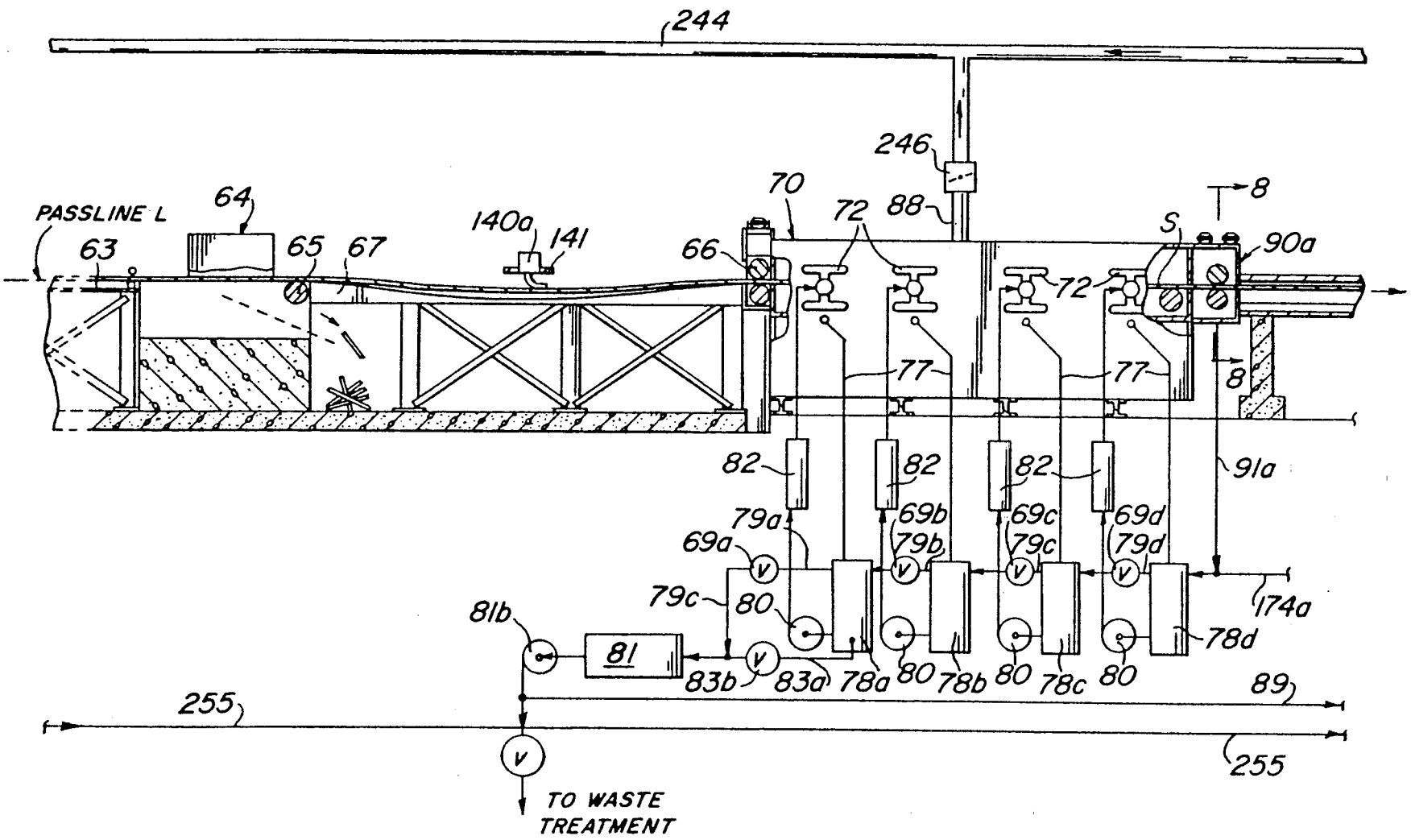
Figure 7:
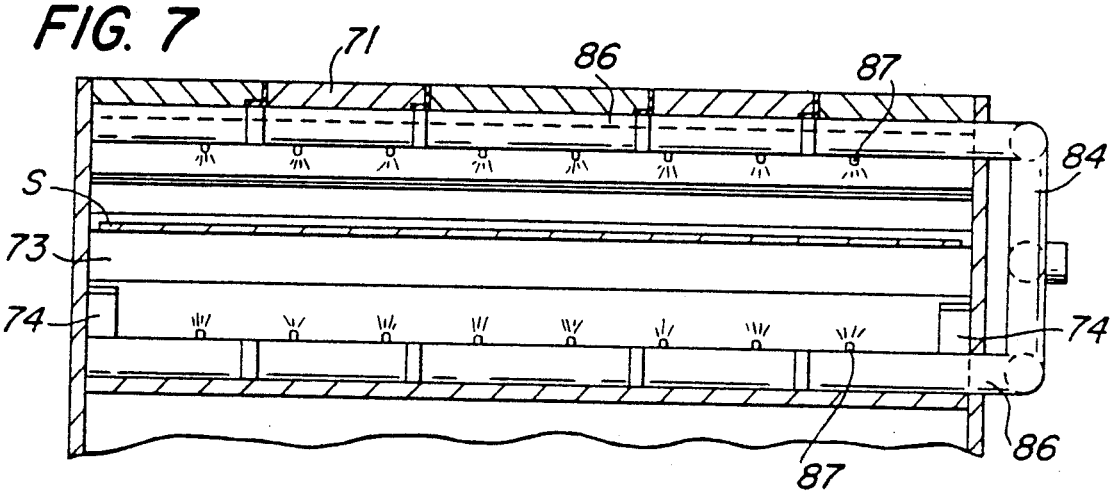
FIG. 7 is a sectional view of the preheater taken along the line 7—7 of FIG. 6.
Figure 6:
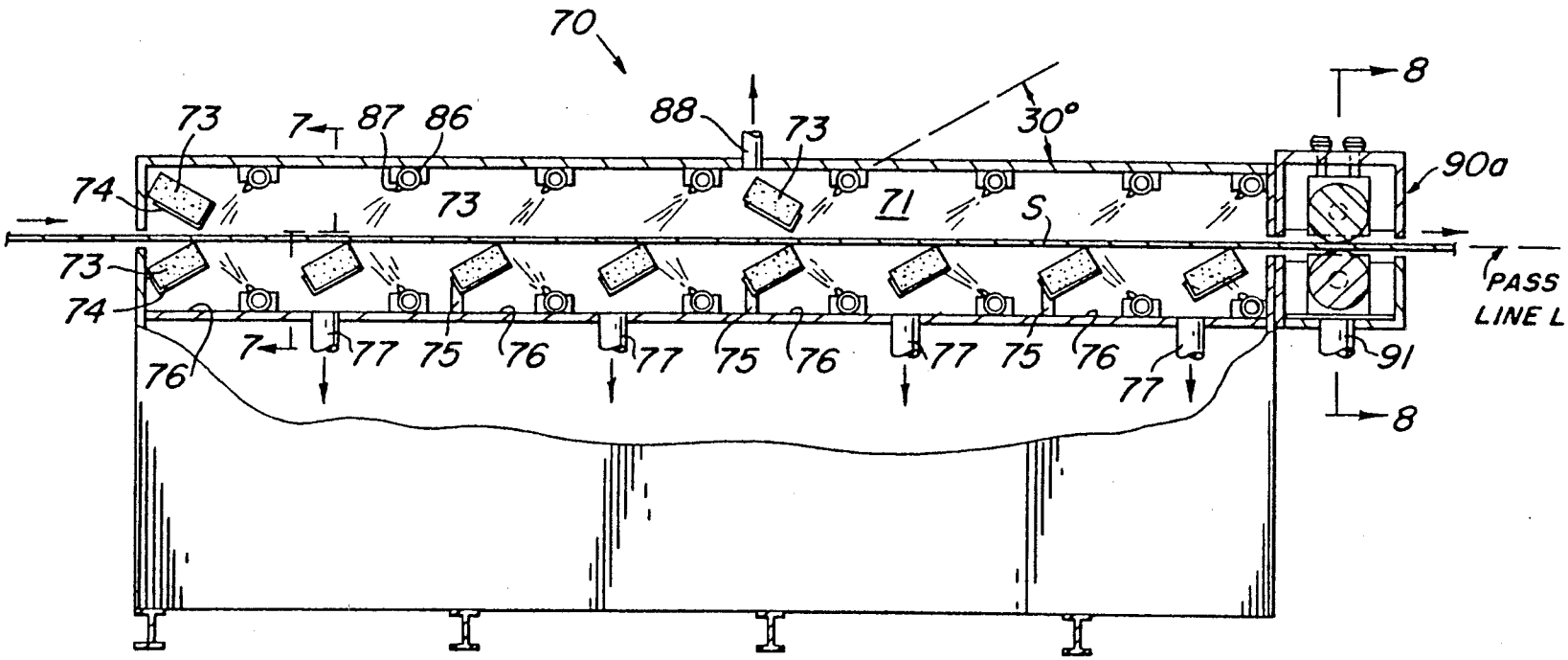
FIG. 6 is a more detailed side elevation view of a preheater and pinch rolls in the apparatus of FIG. 1B for heating the strip to a desired temperature.

Referring to FIG. 6, preheater 70 comprises an elongated spray box 71 having a series of elongated granite slabs 73 supported crosswise at their ends by brackets 74 and spaced along the length of box 71 for guiding strip S on the passline L. The horizontal section of box 71 below passline L is separated along its length by dividers 75 into four troughs 76 which collect the acid flushed against strip S and return it by gravity through drains 77 to respective head tanks 78*a*, 78*b*, 78*c*, 78*d* (FIG. 1B). The acid in each head tank is recirculated by a centrifugal pump 80 through a heater 82 wherein the acid is heated to a temperature preferrably of 210–220° F. Each header 72 includes a manifold 84 (FIG. 7) connecting upper and lower pairs of pipes 86 with nozzles 87 which are directed at approximately 15° to 30° from the horizontal plane into the upper and lower surfaces of the approaching strip S. Intermediate the length of preheater 70, there is a duct 88 for ventilating acid vapors from the space on either side of strip S.

Head tank 78*a* is connected to succeeding head tank 78*b* by an overflow pipe 79*b* and valve 69*b* positioned in tank 78*b* at an acid level slightly above the level in tank 78*a*. Tanks 78*b* and 78*c* are similarly connected by overflow pipes 79*c*, 79*d* and valves 69*c*, 69*d* thereby allowing acid above these levels to cascade by gravity, in a direction opposite to strip S travel, from the head tank 78*d* to tank 78*a*. An overflow pipe 79*a* and valve 69*a* connected to the tank 78*a* slightly below the level in tank 78*b* allow acid to drain to a transfer tank 81. The head tanks are preferrably of the same capacity, such as 400 gallons, but the overflow pipes limit their capacities to lesser amounts, such as 275, 300, 325 and 350 gallons in tank 78*a*, 78*b*, 78*c* and 79*d*, respectively. A drain pipe 83*a* and valve 83*b* provide means for discharging to waste the entire contents of the first tank 78*a*.

Figure 8:
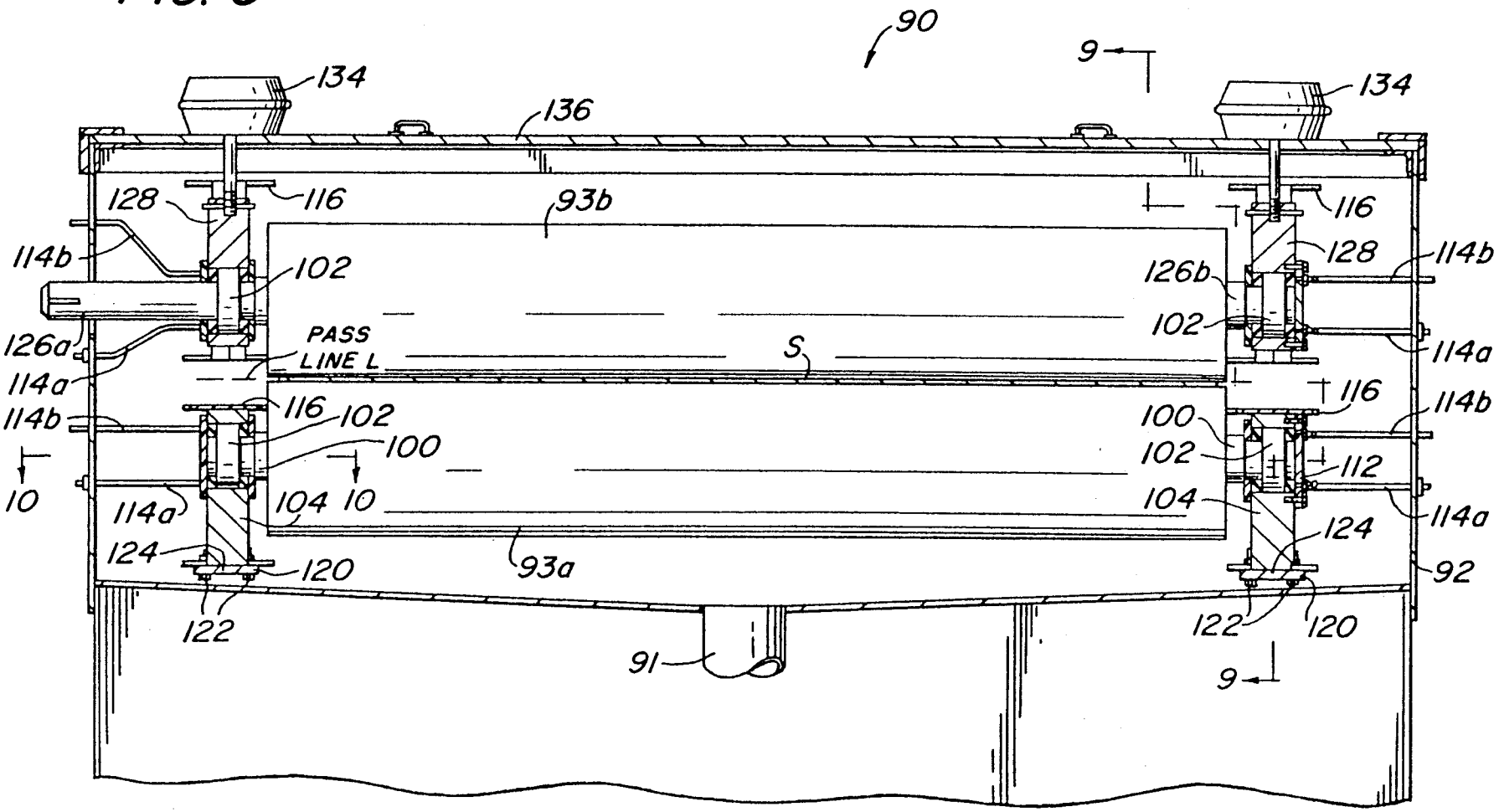
FIG. 8 is a more detailed vertical section of the pinch rolls at the preheater taken along the line 8—8 of FIG. 6.

Strip S is squeeged as it leaves preheater 70 by pinch rolls 90*a*, and the recovered acid flows through a drain 91*a* into the fourth head tank 78. Pinch rolls 90*a* are constructed differently than pinch rolls 36 and 66 to protect critical elements from exposure to the acid. Referring to FIGS. 8, 9 and 10, they include an enclosed trough 92 containing lower and upper rollers 93*a* and 93*b* for compressing against the opposite surfaces of strip S which enters through a slot 94 and emerges at a slot 98 vertically positioned about the passline L. For reasons which will become more apparent hereinafter, the elevation $L_1$ of the lower lip of slot 94 is slightly below the elevation $L_2$ of the lower lip of slot 98.

Lower roller 93*a* includes a metal shaft 100 with the ends fitted with collars 101 and journaled in conventional roller bearings 102 within blocks 104 of an acid-resistant solid fiber glass. Rubber gaskets 106 (FIG.10) on either side of bearings 102 compressed by retainers 108 and titanium fasteners 110 prevent acid from seeping in. Collars 101 and retainers 108 are of an acid-resistant plastic such as polyvinylchloride or polypropylene. Inlet and outlet grease fittings 114*a* and 114*b* provide a means for replenishing or for exchanging the grease when its acidity becomes abnormally high. Fitting 113*a* includes a check valve 114 for preventing grease from flowing back.

The vertical edges 105 of block 104 on either side of shafts 100 are beveled to fit within opposed V-notched vertical guides 115 fixed by brackets 116 to opposite sidewalls 118 of trough 92. Block 104 is seated on a retainer bar 120 secured to the bottom of brackets 116 by fasteners 122. A removable shim 124 is disposed between blocks 104 and bars 120 when needed to align the top of roller 93*a* with the passline L.

Roller 93*b* is journaled like roller 93*a* except that it is motor-driven and moveable in the vertical plane to compress strip S. Shaft 126 extending from either end of roller 93*b* is journaled within blocks 128 in the same manner as described for roller 93*a* except one end of shaft 126 extends beyond one end of trough 92 for engaging a motor output shaft. The beveled edges of each block 128 slides between opposed V-notched guides 130 of brackets 132 which extend from the opposite sidewalls 118 of trough 92. Blooks 128 are urged downwardly to pinch strip S by two pairs of pneumatic actuators 134 with push rods 135 mounted on a trough cover 136 above respective blocks 128.

Figure 1C:
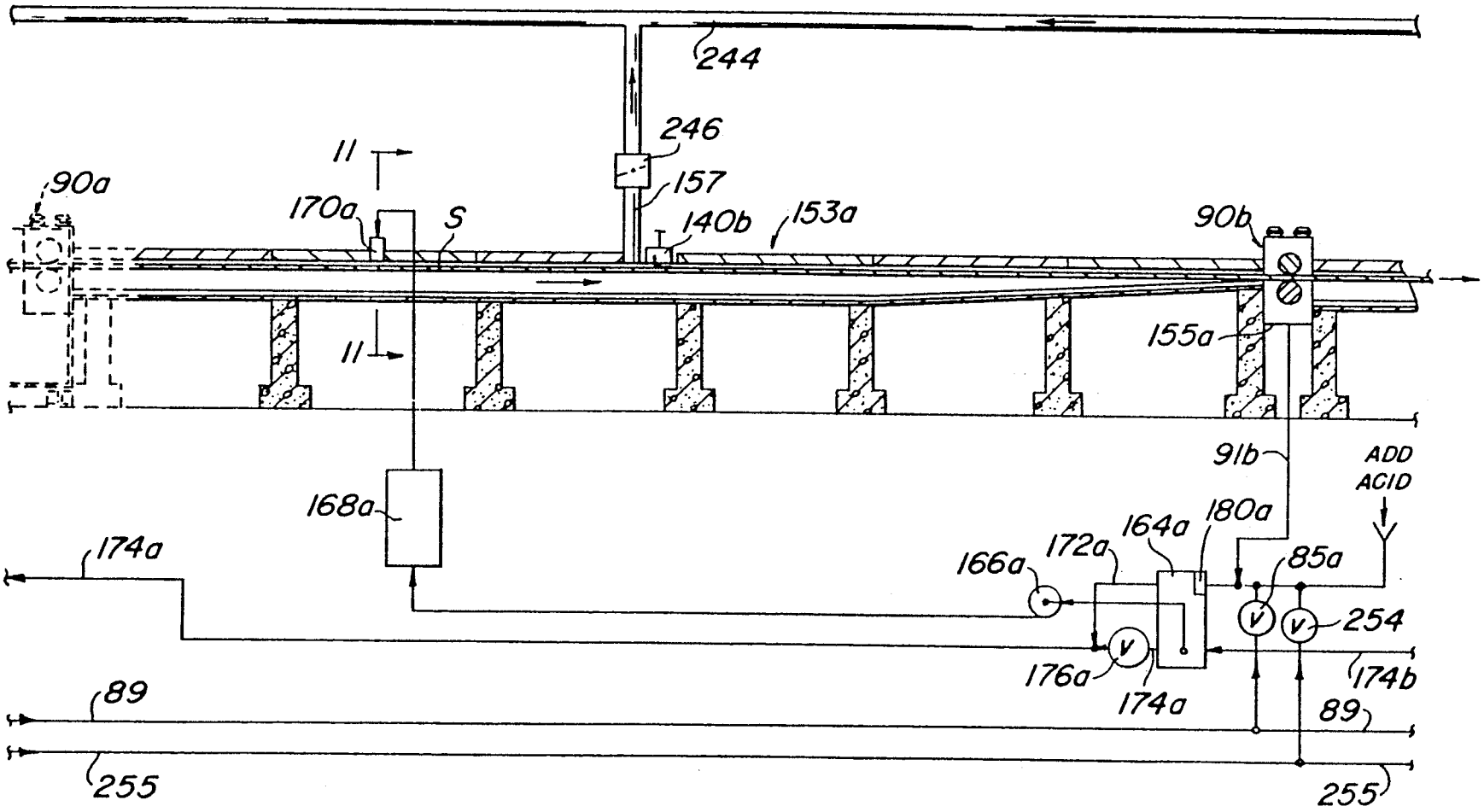
Figure 1D:
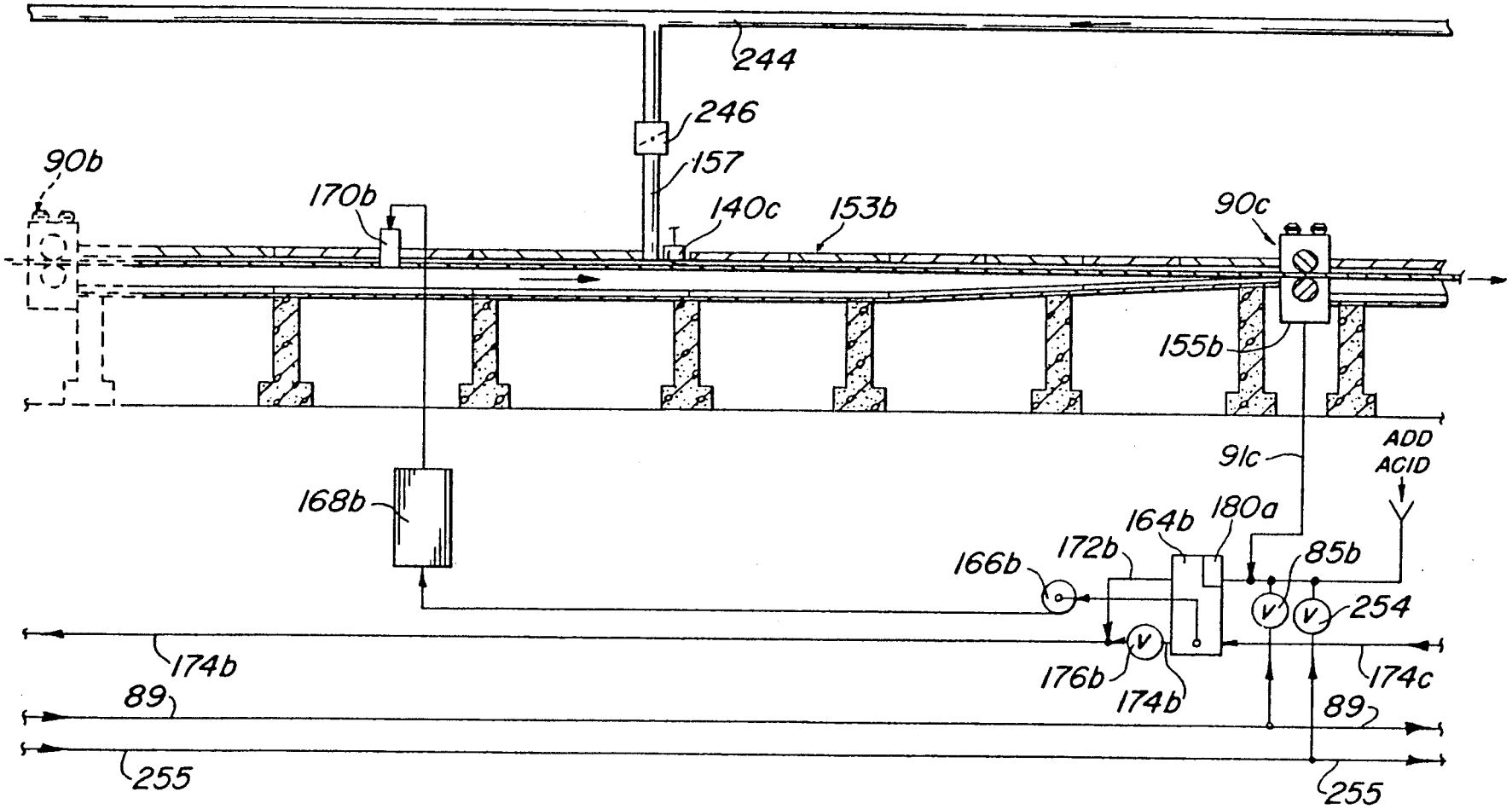
Figure 1E:
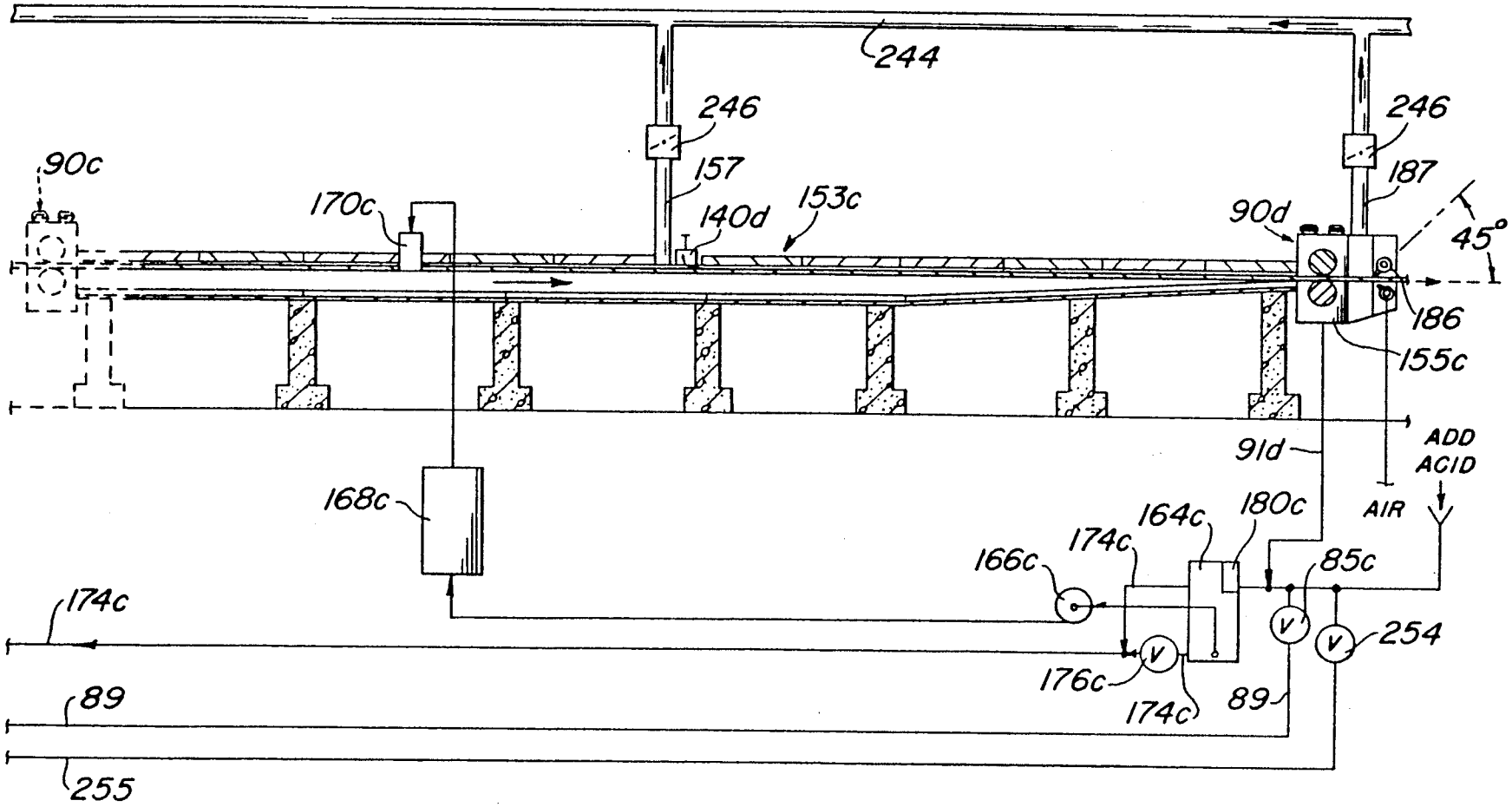

Referring to FIGS. 1C, 1D and 1E, strip S continues through three shallow enclosed pickling tanks 153*a*, 153*b* and 153*c* and their respective pinch rolls 90*b*, 90*c* and 90*d* where it is immersed in a pickling solution such as hydrochloric (HCl) acid of regulated concentrations and temperatures. Pinch rolls 90*b*, 90*c* and 90*d* are constructed substantially like pinch rolls 90*a*. Dancers 140*b*, 140*c* and 140*d*, mounted in the top of each tank midway along the span and midway across strip S, produce electrical signals indicative of strip S sag and control strip speed, like dancer 140*a* described above.

Figure 11:
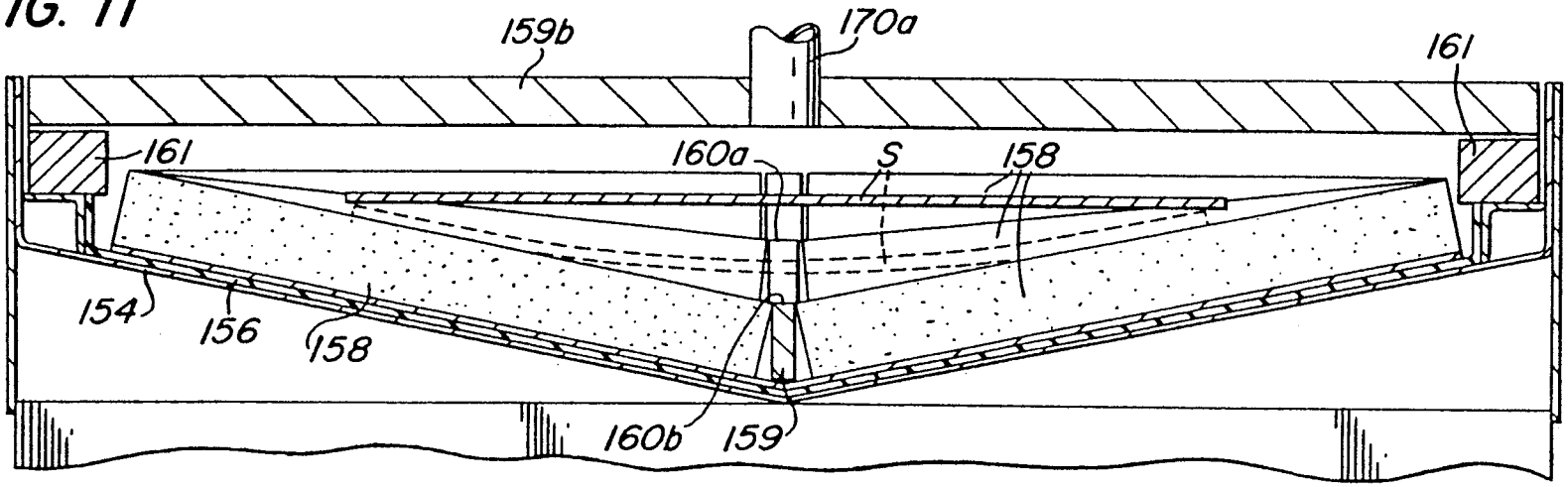
FIG. 11 is a sectional view of a pickling tank in the apparatus taken along the line 11—11 of FIG. 1C.

Referring more specifically to pickling tank 153*a* in FIG. 11, tanks 153*b* and 153*c* being substantially identical, it includes a shallow steel trough 154 with the bottom and sides lined with an acid-impervious rubber layer 156 under acid-resistant flat granite slabs 158. The top of trough 154 is also enclosed by flat granite slabs 159 and includes a duct 157, preferrably near dancer 140*b*, for venting vapors accumulated in the space above the pickling solution.

Figure 13:
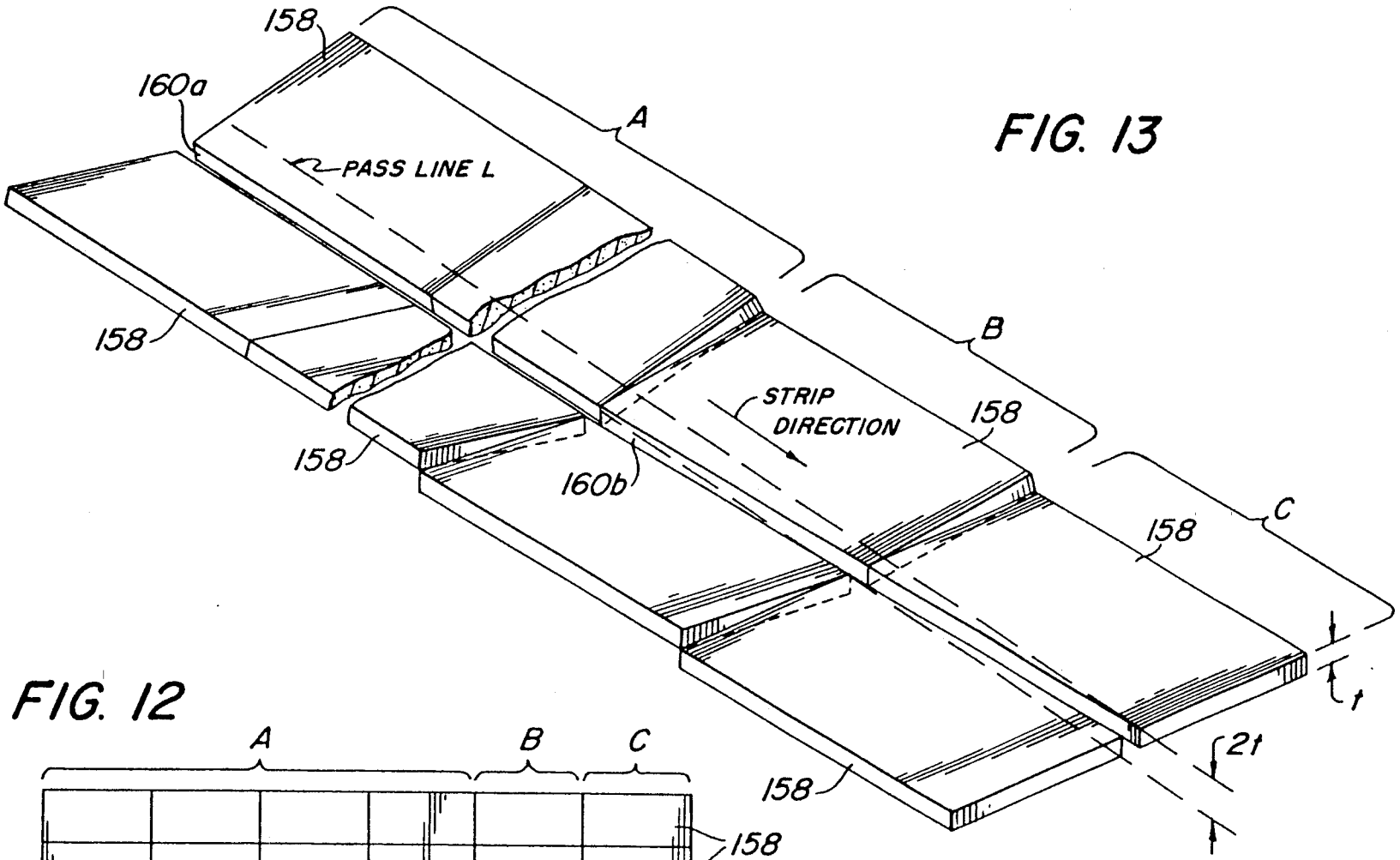
FIG. 13 is a fragmentary isometric view of the slabs of FIG. 12.
Figure 12:
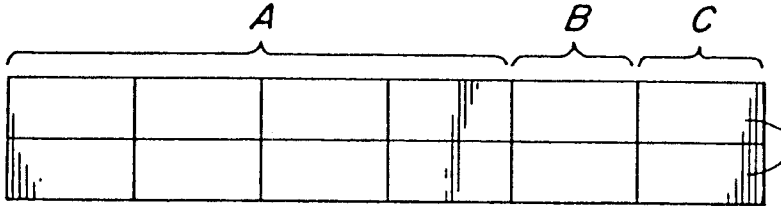
FIG. 12 illustrates in plan view the arrangement of granite slabs in the pickling tank of FIG. 11.

As better illustrated in FIGS. 12 and 13, twelve slabs 158, generally of flat rectangular shape, are arranged in side-by-side pairs along the length of tank 153*a* in three end-to-end sections A, B and C. The four forwardmost pairs define section A as a shallow V-shaped trough with a horizontal apex 160*a* along the bottom preferrably of a depth twice the thickness t of slabs 158. The next pair defines section B as an even more shallow V-shaped trough with an apex 160*b* preferrably of a depth equal to the thickness of slabs 158 and sloping upward from apex 160*a* toward the passline L at the end of tank 153*a*. The last pair of slabs 158 defines section C and lies in a flat plane sloping upward from the adjacent apex 160*b* to passline L. With this configuration, the V-shaped trough in section A enables a thin-gage strip S to be pushed without bulging through tank 153*a* during loading due to the crosswise curve imparted at the strip sides by the sides of the trough. Sections B and C provide a ramp for progressively flattening and feeding the pushed strip S into pinch rolls 90*b*. For example, 5-inch thick slabs 158, would require a depth of 10" from the passline L in section A to any point along apex 160*a*, a decrease from 10" to 5" along apex 160*b* in section B, and a decrease from 5" to zero along the flat ramp in section C. These dimensions have been found suitable for providing enough crosswise sag in a thin gage strip S to prevent it from bulging or folding upon itself as it is pushed through the tank during loading.

The solution through each pickling tank 153*a*, 153*b* and 153*c* flows in the same direction as the strip S through slot 94 into trough 92 of respective pinch rolls 90*b*, 90*c* and 90*d*. The acid collected in the troughs flows through drains 91*b*, 91*c* and 91*d* to head tanks 164*a*, 164*b* and 164*c* where it is recirculated, at least in part, by centrifugal pumps 166*a*, 166*b*, 166*c* through heaters 168*a*, 168*b*, 168*c* to nozzles 170*a*, 170*b*, 170*c* located midway between the sides and approximately one-fourth of the way downstream in each pickling tank and flush with the bottom of slabs 159. The acid level in each pickling tank, determined by the elevation of the lower lip of slot 94 (FIG. 9) at pinch rolls 90*b*, 90*c* and 90*d*, is below the outlet of nozzles 170*a*, 170*b*, 170*c* but above strip S in order that the pickling solution impinge strip S directly downward and divert laterally across the strip at a high velocity sufficient to wash away any oxides and other impurities. In an embodiment constructed as described herein, the capacities of heaters 168*a*, 168*b* and 168*c* are 1000K, 1000K, and 750K Btu/hr., respectively, for maintaining the pickling solution within a preferred temperature range of 170°-220° F.

During normal operation, acid in any head tank 164*a*, 164*b*, 164*c* cascades by gravity to the preceding head tank through run-off pipes 174*a*, 174*b*, 174*c*. The head for inducing flow is created by connecting the run-off pipes of each head tank at an incrementally higher elevations from overflow pipe 79*d* of preheater head tank 78*d*. In a preferred embodiment, the elevation of run-off pipes 174*a*, 174*b*, 174*c* are respectively 2", 4" and 6" above overflow pipe 79*d*. For rapid heating of the acid before a normal run, shut-off valves 176*a*, 176*b*, 176*c* in the run-off pipes are closed, permitting the acid in each head tank 164*a*, 164*b*, 164*c* to accumulate up to overflow pipes 172*a*, 172*b*, 172*c* and cascade by gravity to the preceding head tank and finally to transfer tank 81.

In a preferred embodiment, each pickling stage has a total pickling solution capacity of approximately 1200 gallons of which 400 gallons are present in the head tank when valves 176*a*, 176*b* and 176*c* are closed during heat-up of the acid. When the valves are opened for a normal run, the acid level drops to a about 200 gallons in each head tank 164*a*, 164*b*, 164*c*.

As noted above, the four preheater head tanks 78*a*, 78*b*, 78*c*, 78*d* are connected to cascade toward transfer tank 81. Spent acid, usually less than 2% concentration, flowing to the transfer tank 81 can be returned by a pump 81*b* through pipe 89 and valves 85*a*, 85*b*, 85*c* to any selected pickling tank for supplementing the addition of fresh acid to the pickling tanks. However, when a chemical analysis reveals 18 to 20% by weight of ferrous chloride in the HCl pickling solution, the acid is discharged to a waste storage facility, not shown.

The requirement for new acid, entered into any head tank 164*a*, 164*b*, 164*c*, is determined by periodic or continuous titration of the pickling solutions in the several tanks. The acid concentrations in the three pickling tanks 153*a*, 153*b*, 153*c* may be set at different levels depending on the type and condition of the steel strip being processed, for example 3%, 7% and 12% by volume but not necessarily in that order. Pickling of high carbon steels usually require higher concentrations. As the acidity in last tank 153*c* decreases, the acidity in preceding tanks 153*a* and 153*b* decrease similarly. Conversely, adding acid to tank 153*b* to raise the concentration 2% would also increase the concentration in tank 153*a* by the same amount but without substantially affecting the concentration of tank 153*c*.

The pinch rolls 90*b*, 90*c*, 90*d* at the exits of respective pickling tanks 153*a*, 153*b* and 153*c* squeege the acid carried out by strip S and collect it in troughs 92 for return to the head tanks. A removable basket-type strainer 180*a*, 180*b*, 180*c*, located at each head tank inlet is provided for periodic cleaning out waste solids and other collected particulates from the acid.

At the outlet of pinch rolls 90*d*, strip S may be dried by jets of compressed air from nozzles 186, preferrably ¼" diameter and 10" apart in headers across the strip. The jets are directed into both sides of the approaching strip at approximately 45° above and below the horizontal and vented through a duct 187.

Figure 1F:
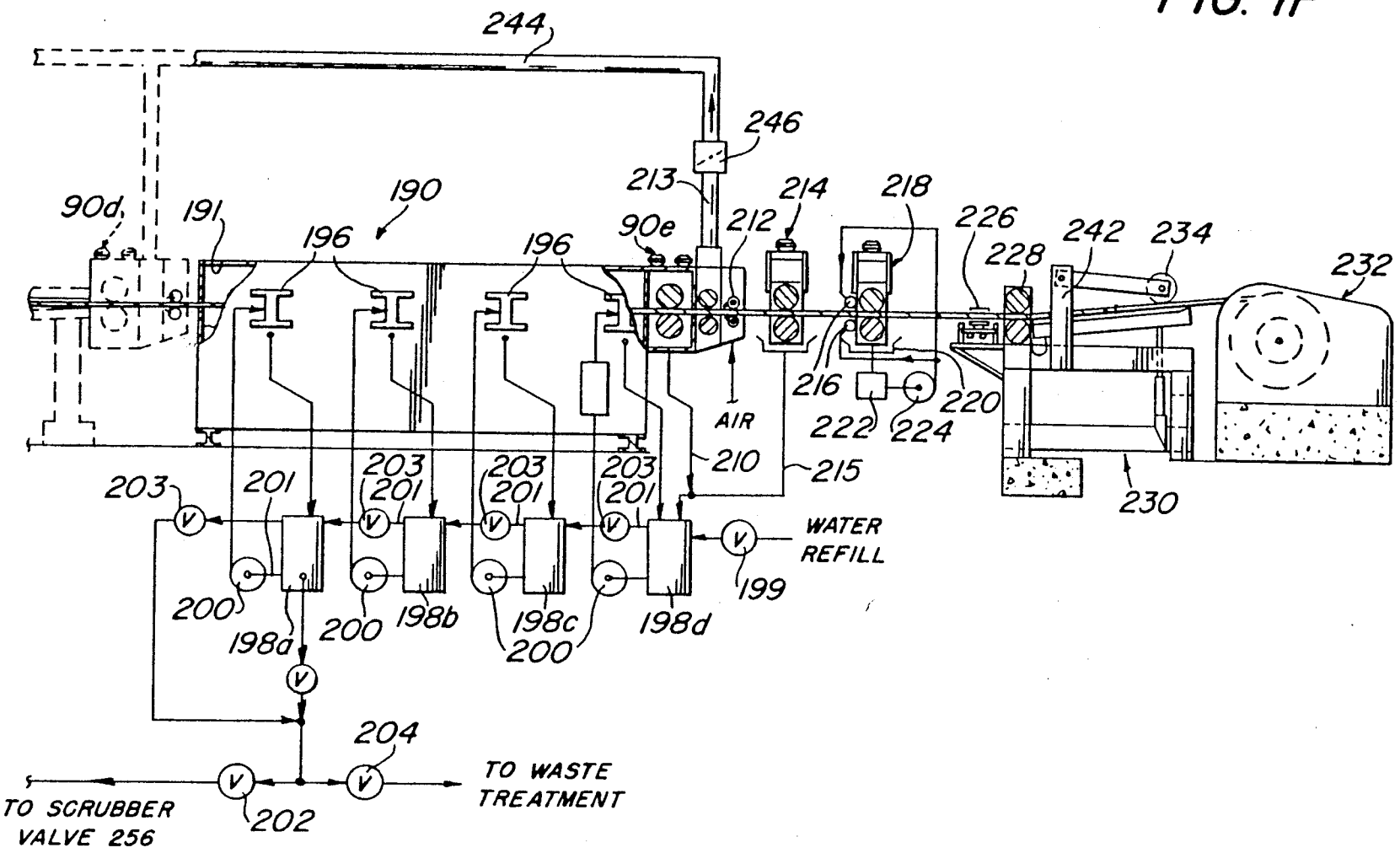

After drying by the air jets, strip S enters an enclosed rinser 190, FIG. 1F, which is constructed like preheater 70 with a spray box 191 along the entire length divided into four serial troughs beneath respective headers 196. Each header 196, like preheater headers 72, includes upper and lower pairs of transverse pipes with nozzles, preferrably ¼" diameter spaced 10" apart, across spray box 191 for expelling water at 30° above and below the horizontal into the approaching strip S. The water from headers 196 collected in each trough drains into respective head tanks 198*a*, 198*b*, 198*c* and 198*d* from which it is recirculated by a pump 200 to headers 196. Water of substantially neutral ion concentration of 6 to 7 pH is added in the last head tank 198*d* and flows forwardly to the first head tank 198*a* reaching a weak acid level such as 3 to 4 pH. Water is added to the last head tank 198*d* through a valve 199. As it is added, the water cascades forwardly through overflow pipes 201 and valves 203, arranged in levels like pipes 79*a*, 79*b*, 79*c*, 79*d* of preheater 70, to a conventional scrubber 206 (FIG. 1A) via valve 202 or to a waste treatment system, not shown, via valve 204. Water circulated through the last head tank 198*d* is also heated by a heater 208 to a water temperature preferrably between 130° and 180° F.

Idler pinch rolls 90*e*, constructed like pinch rolls 90*a* except not motor-driven, at the exit of rinser 190 squeeges strip S with the excess water returning to the last head tank 198*d* via drain 210. Nozzles 212, preferrably 6" apart across the strip S, direct jets of air at approximately 45° above and below the horizontal into both sides of the approaching strip S. The resulting air-vapor mixture is vented by duct 213.

Strip S then passes through idler pinch rolls 214, like idler pinch rolls 90*d*, where any residual water on strip S is squeeged off and returned to head tank 198*d* by drain 215.

A protective thin film of oil is sprayed on strip S by nozzles 216 directed into the intake side of oiler idler pinch rolls 218 where excess oil is squeeged into a trough 220 for recirculating through an oil supply tank 222 by a pump 224. It is preferred that rolls 218 be separated from rolls 214 a distance sufficient to allow time for strip S to dry completely before oiling.

Strip S now proceeds between edge guides 226 and idler rolls 228 for alignment of the strip over a feeder 230 which positions the end of strip S at a recoiler 232 for rewinding. Feeder 230 is essentially constructed like peeler 34 except that blade 40 now acts as a ramp to guide strip S to recoiler 232.

Figure 14:
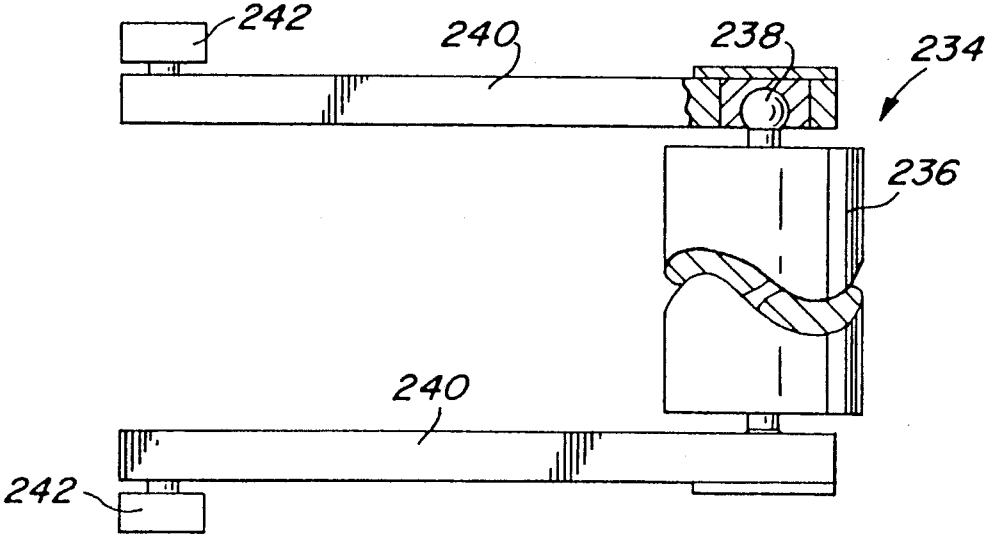
FIG. 14 is a plan view of a camber compensator in the apparatus of FIG. 1F.

Camber caused by variations in the relative side-to-side length of the strip S will produce irregularly wound coils. To compensate for such variations and ensure even winding, a heavy roller 234 is provided. Referring to FIG. 14, the roller 234 includes a shot-filled cylinder 236 mounted in spherical bearings 238 at the ends of parallel arms 240 which, in turn, are independently pivotal at fixed stanchions 242. As one side of strip S slackens relative to the other due to differences in length, the weight of roller 236 will add a momentary tension to the slack side helping the strip to wind evenly.

Any vapor accumulated in the course of pickling or rinsing is exhausted through duct 244 communicating through adjustable dampers 246 with duct 88 of preheater 70, ducts 157 of pickling tanks 153*a*, 153*b*, 153*c*, and ducts 187 and 213 associated with air jet nozzles 186 and 212. An exhaust fan 248 (FIG. 1A) draws the vapors into scrubber 206 where it is condensed to an acid concentrate, for example 2% by volume, for recycling by a pump 250, valves 252 and 254 and pipe 255 to selected head tank 164*a*, 164*b* or 164*c*. Water for condensing the vapors in scrubber 206 is drawn as needed from either rinser head tank 198*a* or from a separate supply through valves 256 or 258, respectively.

Figure 15:
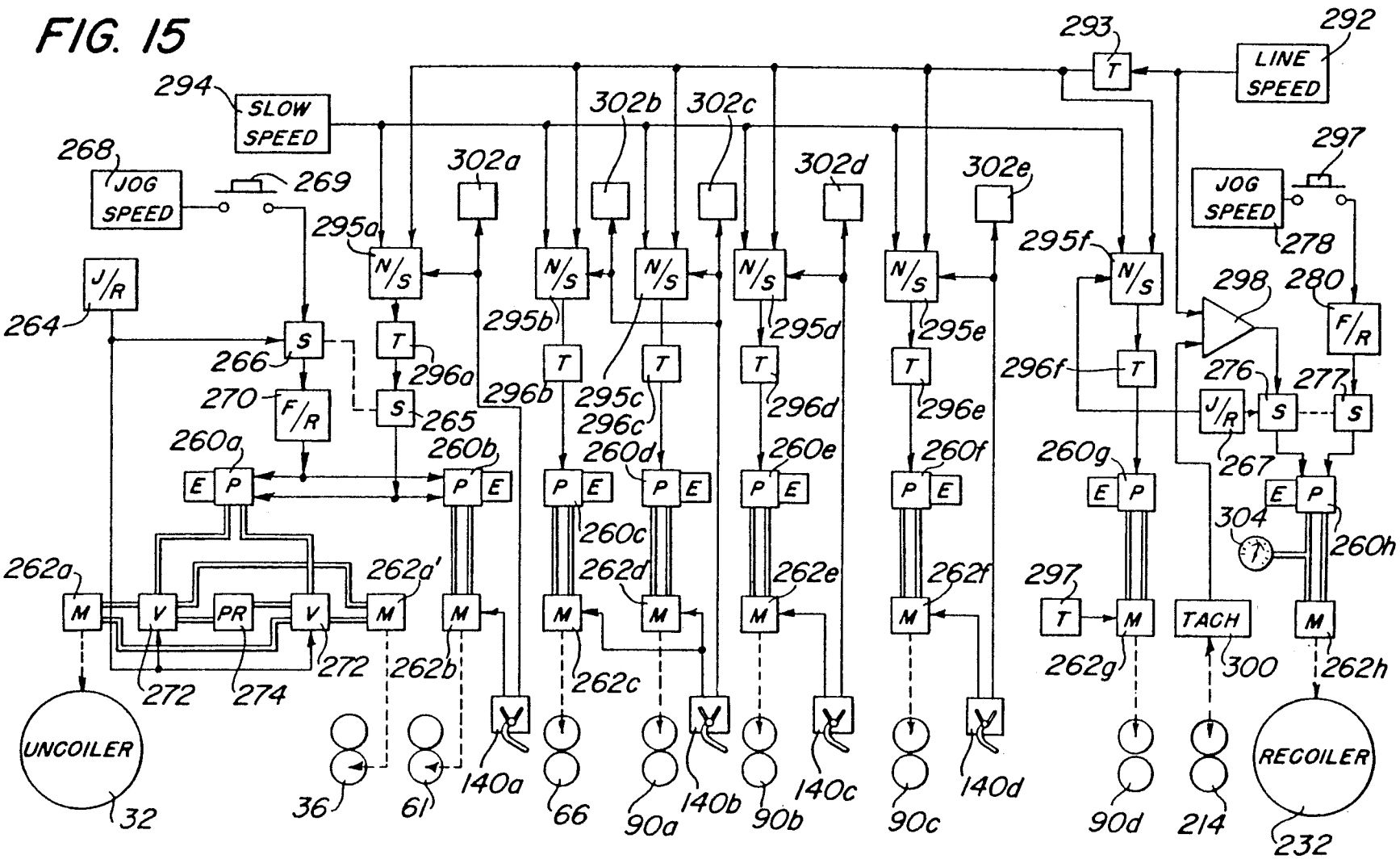
FIG. 15 is a block diagram of a strip speed control system as applied the apparatus of FIGS. 1A-1F.

The strip speed throughout the process is controlled by a unique arrangement of conventional constant-pressure, variable-displacement hydraulic pumps and motors, functionally identified in FIG. 15 as P and M respectively, driving uncoiler 32, seven pinch rolls, and recoiler 232. HD Series Variable Speed Hydrostatic Drives by Dynex/Rivett Inc. as disclosed in Dynex/-Rivett Bulletin SHD-0484 have been used in a preferred embodiment of the invention. Referring to FIG. 15, pumps 260*a*–260*h* and motors 262*a*–262*h* are mechanically identical to each other but are hydraulically connected to operate in complementary pairs. Each pump is driven by constant-speed electric motor functionally identified in FIG. 15 by the letter E. Each pump includes a servovalve, not shown, actuated in a well-known manner by a pair of electrical coils which adjust the pump stroke or displacement according to a variable d.c. signal to either coil. The pump hydraulic output causes an associated motor, operating in reverse of the pump, produces a rotary shaft output. At a constant stroke of the motor, its shaft speed will vary according to the d.c. signal to a pump coil; however, the speed of the motor may also be regulated by a servovalve, not shown, actuated in a well-known manner to vary the motor stroke or displacement according to a variable d.c. signal to a coil within the motor. The specific arrangement of the pump and motor combinations utilized for speed regulation in the pickling system will become more apparent hereinafter.

There are two primary system operating modes, JOG and RUN, selected at mode switches 264 and 267. In the JOG mode, switch 264 disables the RUN mode and closes relays 265 and 266 enabling three motors 262*a*, 262*a*′ and 262*b*, driving the uncoiler 32, peeler pinch rolls 36, and flattener rollers 61 to respond to a JOG speed command d.c. signal. A JOG speed command 268 transmits the signal according to a selected speed through a JOG pushbutton switch 269, relay 266, and a Forward/Reverse selector switch 270 to stroke-adjusting coils of pumps 260*a* and 260*b* for slowly and intermittantly feeding the end of the strip S through peeler pinch rolls 36 and flattener rollers 61 to a starting position at pinch roll 66. Pump 260*a* operates both motors 262*a* and 262*a*′ of uncoiler 32 and pinch rolls 36, through two electrically-actuated valves 272 which are hydraulically interconnected by a pressure reducer 274. The JOG signal from switch 264 closes valves 272 causing the high pressure output, e.g. 5000 psi, of pump 260*a* to drive both motors 262*a* according to the output of JOG command 268. Pump 260*b* also responds to the JOG command to drive motor 262*b*. Thus, uncoiler 32, pinch rolls 36 and flattener rollers 61 JOG in unison with manual closure of JOG pushbutton switch 269. In the RUN mode, switch 264 opens valves 272 causing the hydraulic fluid to circulate through pressure reducer 274 and produce a pre-set low drag or braking pressure, e.g. 300 to 400 psi, at uncoiler motor 262*a* while pinch rolls motor 262*a*′ continues receiving a normal operating pressure.

For rewinding the end of strip S as it comes off feeder 230, the JOG mode is selected at switch 267 which disables the RUN mode and closes relay 277. A motor 262*h*, which drives recoiler 232, can now respond to a JOG speed command d.c. signal generated by a manual JOG speed command 278. The d.c. signal, according to a selected command speed, is transmitted through a JOG pushbutton switch 279 and a Forward/Reverse selector switch 280 to a stroke-adjusting coil of pump 260*h*. It is contemplated that a second pump, not shown, may be hydraulically connected in parallel with pump 260*h* for increasing the hydraulic volume to motor 262*h* and thereby increase the speed.

Forward/Reverse selector switches 270 and 280 each enable an operator to reverse the direction of strip S travel by changing the polarity of the JOG speed command signal and thereby reverse the direction of hydraulic flow from pumps 260*a* and 260*h* and the rotation of their corresponding motors.

In the RUN mode selected at switches 264 and 267, relays 265, 266 and 276, 277 transfer speed control of strip S through the process to either of two speeds, LINE or SLOW. The LINE speed command signal is connected through a tension trimmer 293, selector relays 295*a*–295*f* and trim adjusters 296*a*–296*f* to the coils of pumps 260*a*–260*h* associated with the motors 262*a*–262*h* of uncoiler 32 and pinch rolls 36, 66, 90*a*–90*d* and flattener rollers 61. A trim adjuster 297 at motor 262*g*, associated with pinch rolls 90*d* at the exit of pickling tank 153*c*, provide further means for modifying the speed signal set at LINE speed command 292. The output from LINE speed command 292 is also connected to one input of a comparator 298 which compares the LINE speed signal to the actual speed signal measured at a tachometer 300 driven by idler pinch rolls 214.

The transducer outputs of dancers 140*a*–140*d* are connected to the stroke-adjusting coils of motors 262*b*–262*f* for adjusting the stroke and thereby modifying the command speed determined by the speed command signal to pumps 260. Transducer 152 in each dancer 140*a*–140*d* is set to a neutral position where the vertical position of dancer arm 142 corresponds to the desired tension or sag positions of the strip during normal operation. As the sag changes, the electrical output to the pinch roll motor immediately preceding the dancer alters the motor speed to maintain a constant tension between pinch rolls.

The limit switches 150 at dancers 140*a*–140*d* transmit an electrical signal to selector relays 295*a*–295*e* if the strip sag exceeds either a preselected maximum or minimum tension. In either of these events, the dancer affected transfers control from a LINE to a SLOW command speed for the immediately preceding pinch roll motor. At the same time, the pressure to the pneumatic actuator 54 or 134 of the pinch roll is relieved by electrically-actuated pressure relief valves 302*a*–302*e* to allow the rolls to slip relative to the strip S. Consequently, the motor driving the strip moves to a SLOW speed until the strip tension normalizes.

Before starting the pickling process with steel strip, it is essential that all pinch rolls operate initially at the same speed. This is accomplished with electric motors E on all pumps 260*a*–260*h* running at substantially constant speed and with switches 264 and 267 in the RUN mode. The stroke of each pump 260 is then mechanically adjusted in a well-known manner until there is no displacement, i.e. zero hydraulic output. A LINE speed is selected at command 292 for an anticipated full operating speed, e.g. 100 feet per minute. The output is connected to one coil of each pump to increase the stroke or displacement sufficient to produce a hydraulic flow to its companion motor or motors. The stroke in each motor is then mechanically adjusted in a well-known manner for minimum displacement, i.e. maximum speed, with no voltage applied to the motor coil. The speed of motor 262*g* is now adjusted to slightly below full speed, e.g. 90 fpm, with trim adjuster 297. The LINE and SLOW speed commands 292 and 294 are now returned to zero for startup.

Mode switch 264 is moved to JOG to move strip S up to pinch rolls 66. At this point the mode switch 264 is returned to RUN and LINE speed command 292 slowly increased to feed strip S through the tanks to feeder 230 where it is gripped by recoiler 232 operating in the JOG mode.

In the RUN mode, recoiler 232 is driven by motor 262*h* in response to the output at comparator 298 which is the difference between the LINE speed signal of command 292 and the measured speed by tachometer 300 at the idler pinch rolls 214. The difference signal is connected through relay 276 to the stroke-adjusting coil of pump 260*h* which varies the pump displacement and, in turn, the motor speed. Thus, a decrease in strip speed produces an increase in the output signal from comparator 298 to increase the pump stroke and shaft speed of recoiler motor 262*h*. A constant tension, as indicated by pressure gage 304 of the hydraulic pressure to motor 262*h*, is applied to the strip between pinch rolls 90*d* and recoiler 232 by tension trimmer 293. That is, the LINE speed signal to pump 262*h* is slightly higher than to pumps 260*a*–260*g*.

SUMMARY OF OPERATION

The pickling process typically begins with charging the preheater 70, pickling tanks 153*a*, 153*b*, 153*c* with acid and rinser 190 with water and circulating them through the heaters until they reach the desired temperatures. In the case of pickling tanks 153*a*, 153*b* and 153*c*, run-off valves 176*a*, 176*b* and 176*c* are closed to obtain the appropriate acid concentration in each tank before allowing the acid to cascade through the process. The various pumps, motors and trimmers are adjusted in the manner described hereinabove for a constant line speed at each pinch roll; and dancers 140*a*, 140*b*, 140*c* set for maintaining a desired tension through the process. A coil of metal strip S is mounted in uncoiler 32 with hold-down roller 35 positioned to prevent self-unwinding while steel bands, placed around the coil for shipping, are removed. The JOG mode is now selected at the mode switch 264 and a JOG speed selected at command 268. Peeler table 40 is hydraulically manipulated under the leading end of the coiled strip S while JOG pushbutton 269 is intermittently pressed to advance the end of strip S through pinch rolls 36, edge guides 38, flattener 60 to shear 64 where any irregular end is cut off of strip S. Edge guides 38 enable the strip to be properly centered in the line. The strip is now "jogged" to engage pinch roll 66 at the entrance to preheater 70 at which point switch 264 is placed in the RUN mode and the line speed command 292 slowly increased to push strip S through preheater 70, pickling tanks 153*a*–153*c*, rinser 190, and the associated pinch rolls to recoiler 232. Mode switch 267, in the JOG position, now permits the JOG speed from command 278 to position recoiler 232 to accept the end of strip S whereupon the line speed command may now be increased to the desired speed for a normal pickling operation. Primary speed control is maintained at pinch roll 90*d*, however, as recoiler 232 increases in diameter with winding of the strip, the speed of motor 262*h* is reduced to maintain a constant tension of the strip between rollers 90*d* and recoiler 232. That is, as recoiler 232 tends to increase, the line speed change is sensed at tachometer 214. The resulting change in the differential signal between the outputs of tachometer 214 and the LINE speed command 292 causes motor 262*h* to reduce speed proportionately. In the event of a change in strip tension within any pickling tank as might cause the strip to drag on the bottom of the tank or rise above the acid, the dancer 143*a*, 143*b*, 143*c* at that tank provides a signal to the motor of the preceding pinch rolls to speed up or slow down, as appropriate. In the event of an extreme deviation in strip tension in any pickling tank, the dancer will actuate the associated relays 295*a*–295*e* and 302*a*–302*e* to transfer the operation of the preceding pinch roll to SLOW speed and release the pressure on the pinch rolls at that point.

During operation, the acid concentration of the various head tanks is periodically measured and acid added as needed. In most cases, the acid is added to the last head tank 164*c* of the pickling stages and the mixed solution allowed to cascade forwardly to the first head tank 178 of preheater 70. At that point, based upon its condition, the acid is either recirculated through a pickling tank or discharged to waste. While the system is in operation, the vapors generated in the acid processing stages are drawn off to scrubber 206 which reclaims the acid from the vapors for recycling to any selected pickling tank.

Some of the many advantages and novel features of the invention should now be readily apparent. A pickling process and apparatus is provided which includes an environmentally safe chemical waste disposal system, and an efficient acid recovery and recirculation system. The combination of shallow pickling tanks and head tanks significantly reduces the total acid requirements within the system at any instant in time as well as minimizes thermal lag and affords faster response to temperature changes. With a separate heater for each pickling tank, the acid can be closely maintained at the most efficient reaction temperature. Location of the acid nozzles in each pickling tank provides rapid dispersal of particulate impurities off the strip. Separate acid circulating systems in each pickling tank enables acid concentrations to be carefully controlled and varied in each tank and allows selected tanks to be shut down for maintenance without disrupting operation of the others. The use of separate head tanks permits the addition of new acid in the head tanks instead of directly into the pickling tanks thereby avoiding rough, granular surface finishes caused by strip "burn". The acid recirculating system is particularly helpful in conserving acid with a relatively low replenishment. The strip line speed and immersion control in the pickling tanks, particularly for light, narrow gauge metals, are precisely maintained by a unique electro-hydraulic speed control system.

It will be understood that various changes in the details, step and arrangement of parts, which have been described herein and illustrated in order to explain the nature of the invention, may be made by those skilled in the art within the principle and scope of the invention as expressed in the appended claims.

What is claimed is:

1. Apparatus for regulating the tension in a moving strip spanning two pairs of pinch rollers, comprising, in combination:

speed command means producing a first electrical signal indicative of a desired strip speed;

a pair of reciprocating pumps, each driven at constant speed and having an adjustable variable displacement stroke responsive to said signal for varying the flow rate at the output of each of said pumps;

reciprocating motors hydraulically connected to the respective outputs of said pumps for varying the rotary speed at the output of each of said motors and for driving respective pairs of the pinch rollers in accordance with said first signal, said motors each having an adjustable stroke;

transducer means formed to be disposed intermediate the span of the pairs of pinch rollers for measuring the sag of the strip and producing a second electrical signal indicative thereof, said second signal being operatively connected to one of said motors for adjusting the stroke and thereby varying the rotary speed of one pair of said pinch rollers relative to the other pair of said pinch rollers.

2. Apparatus according to claim 1 further comprising:

limiting means detecting sag beyond selected limits formed to release one pair of the pinch rolls.

3. In a metal strip pickling apparatus including a series of pickling tanks and a pair of pinch rolls between adjacent ones of the tanks and at each end of the series for transporting a continuous metal strip lengthwise through the tanks from a supply reel to a take-up reel, a tension control system comprising:

first means responsive to a command signal for regulating the strip speed at each pair of pinch rolls; and second means responsive to the strip sag in each of the tanks for modifying the command signal to one pair of pinch rolls of the associated tank.

4. A tension control system according to claim 3 wherein:

said second means includes a sensor for detecting the vertical position of the strip at a point between adjacent pairs of pinch rolls.

5. A tension control system according to claim 3 further comprising:

third means responsive to the command signal and strip speed for regulating the speed of the take-up reel.

6. A tension control system according to claim 5 wherein:

said third means includes a tachometer for producing an output indicative of the strip speed, and a comparator receiving the tachometer output and the command signal.

7. A tension control system according to claim 3 further comprising:

command means for generating a normal speed and slow speed command signals; and switch means for selecting one of said signals for regulating the strip speed.

8. In a metal strip pickling apparatus including a pickling tank and two pairs of pinch rolls at respective ends of the tank for transporting a continuous metal strip lengthwise through the tank from a supply reel to a take-up reel, a tension control system comprising:

speed command means producing a first electrical signal indicative of a desired strip speed;

a pair of reciprocating pumps, each driven at constant speed and having an adjustable variable displacement stroke responsive to said first signal for varying the flow rate at the output of each of said pumps;

reciprocating motors hydraulically connected to the respective outputs of said pumps for varying the rotary speed at the output of each of said motors and for driving respective pairs of the pinch rolls in accordance with said first signal, said motors each having an adjustable stroke; and transducer means formed to be disposed intermediate the span of the pairs of pinch rolls for measuring the sag of the strip and producing a second electrical signal indicative thereof, said second signal being operatively connected to one of said motors for adjusting the stroke and thereby varying the rotary speed of one pair of said pinch rolls relative to the other pair of said pinch rolls.

9. A tension control system according to claim 8 further comprising:

limiting means detecting sag beyond selected limits formed to release one pair of the pinch rolls.

* * * * *